US008333429B2

(12) United States Patent
Nelson et al.

(10) Patent No.: US 8,333,429 B2
(45) Date of Patent: Dec. 18, 2012

(54) REMOVABLE CUP HOLDER FOR ARM OF SEAT

(76) Inventors: Jeff Nelson, Lebanon, OH (US); Jenise Nelson, Lebanon, OH (US)

( * ) Notice: Subject to any disclaimer, the term of this patent is extended or adjusted under 35 U.S.C. 154(b) by 15 days.

(21) Appl. No.: 13/207,735

(22) Filed: Aug. 11, 2011

(65) Prior Publication Data

US 2012/0007394 A1 Jan. 12, 2012

Related U.S. Application Data

(62) Division of application No. 11/951,143, filed on Dec. 5, 2007, now abandoned.

(60) Provisional application No. 60/868,692, filed on Dec. 5, 2006.

(51) Int. Cl.
*A47C 7/62* (2006.01)

(52) U.S. Cl. ..... 297/188.18; 297/188.14

(58) Field of Classification Search ..... 297/188.14, 297/188.18, 188.01
See application file for complete search history.

(56) References Cited

U.S. PATENT DOCUMENTS

| | | | | |
|---|---|---|---|---|
| 3,690,724 | A | 1/1972 | Douglas | |
| 4,256,281 | A * | 3/1981 | Harris et al. | 248/230.9 |
| 4,262,962 | A | 4/1981 | Yust | |
| 4,728,147 | A | 3/1988 | Dutton | |
| 4,844,399 | A * | 7/1989 | Harm | 248/311.2 |
| 4,865,237 | A * | 9/1989 | Allen | 224/552 |
| 5,232,262 | A | 8/1993 | Tseng | |
| 5,238,212 | A | 8/1993 | Dechellis | |
| 5,302,000 | A | 4/1994 | Ayotte | |
| 5,395,085 | A | 3/1995 | Mann | |
| 5,474,272 | A | 12/1995 | Thompson et al. | |
| 5,533,782 | A | 7/1996 | Goldman | |
| 5,597,148 | A * | 1/1997 | Gospodarich | 248/311.2 |
| 5,695,162 | A | 12/1997 | DiCastro | |
| 6,352,303 | B1 | 3/2002 | Hope | |
| 6,478,371 | B1 | 11/2002 | Clarke | |

* cited by examiner

*Primary Examiner* — David Dunn
*Assistant Examiner* — Tania Abraham
(74) *Attorney, Agent, or Firm* — Wood, Herron & Evans, LLP

(57) ABSTRACT

A cup-holding device configured to be retrofitted to an arm-rest or other horizontal support structure. The cup-holding device has a basket in a seat mounting portion wherein there is sufficient rigidity of the structure to hold a cup with a fluid mass therein.

8 Claims, 12 Drawing Sheets

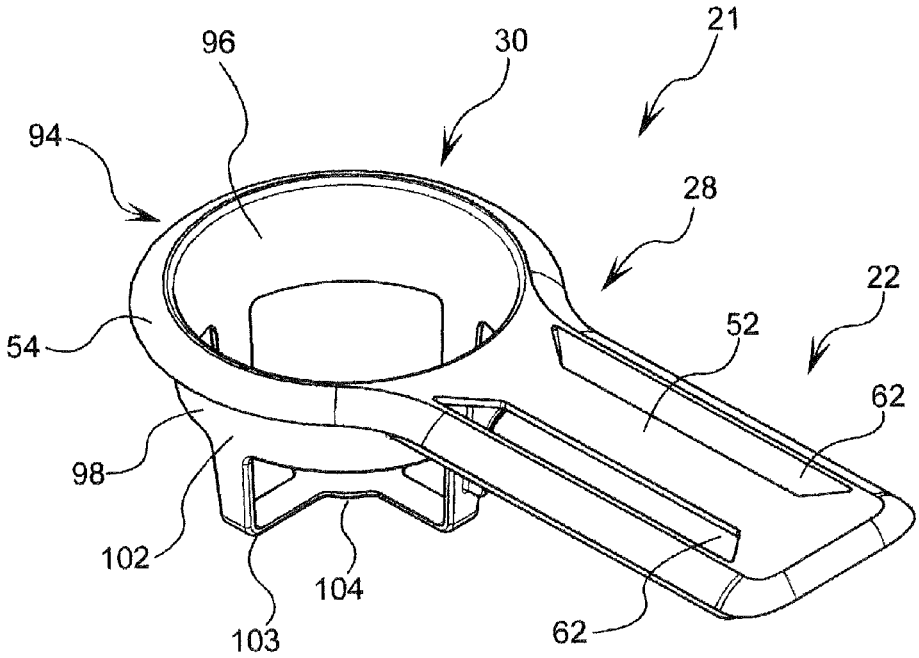
FIG. 1
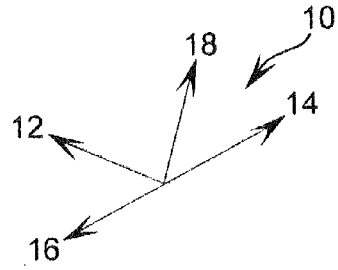

REMOVABLE CUP HOLDER FOR ARM OF SEAT

RELATED APPLICATIONS

This application is a divisional application of and claims priority benefit of U.S. patent application Ser. No. 11/951,143 filed Dec. 5, 2007 now abandoned, which in turn claims priority benefit of U.S. Provisional patent application Ser. No. 60/868,692, filed Dec. 5, 2006.

BACKGROUND OF THE DISCLOSURE a) Field of the Invention

The invention relates to an apparatus removably attached to the arm of a seat for the purpose of holding beverages, food, and similar concessions.

b) Background Art

The invention relates to the art of cup holders that generally are attached to seats for the purpose of holding beverages, food, and similar concessions.

Anyone who has gone to a sporting event or to a stadium has noticed that the purchase and consumption of beverages and other articles is necessary given the extended time that is often seen at a sporting event such as football. Oftentimes it becomes necessary to set one item down when both hands are needed or when moving from one place to another. Some stadium seating has been adapted to have built-in beverage containers; however, older stadiums may need to be fitted with such containers to be practical and was not configured originally with such a means for holding beverages and the like, or possibly, during their use, such objects have become nonfunctional or broken. Thus the need for a retrofit of set beverage holders and article holders has been considered and reviewed in several different patents, including Decastro U.S. Pat. No. 5,695,162 and Clark U.S. Pat. No. 6,478,371 Yust U.S. Pat. No. 4,262,962. However, these inventions fall far short of the need either for permanent retrofitting required to install said devices, or in their limited applications.

U.S. Pat. No. 6,478,371 (Clarke) shows a retractable and removable concession holder where as shown in the various figures, the seat attachment portion is permanently attached to the underside portion of the stadium seating. As shown, the dove tail-like receiving member is adapted to engage the upper slot portion of the concessions container. This permanent attachment is very costly to implement and precludes the use of other vessel holders.

U.S. Pat. No. 6,352,303 (Hope) discloses an armrest for a mouse pad where as shown, the straps attach to the armrest by a hook and loop-like fastener such as Velcro™.

U.S. Pat. No. 5,695,162 (DiCastro) discloses a holder for beverages where the beverage container is slipped over the edge portion of a bleacher seat. As shown in the patent, the beverage container will deform and flatten should a spectator accidentally step or sit on a holder. It should be noted that the drawings, show a wooden plank seat where a saw-tooth surface is adapted to firmly grip the plank. This patent describes an invention which can be attached to the seat of a stadium seating apparatus. This patent is very flimsy and does interfere with seating, and further involves a U-shaped clip adapted to be slipped over the edge of a stadium seat. Furthermore, it is shown to be installed on a bleacher style seat, specifically, the edge of a flat horizontal seating surface.

U.S. Pat. No. 5,533,782 (Goldman) discloses another armrest attachment. This patent is adapted to be permanently attached to an armrest with similar disadvantages to the U.S. Pat. No. 6,478,371 above.

U.S. Pat. No. 5,474,272 (Thompson et al.) discloses a portable cup holder with a retaining-like second ring. The securing straps are to be Velcro™-type fastening strips. This appears to have a difficult attachment-type set up. This patent relies on the first and second rings to hold the cup securely.

U.S. Pat. No. 5,395,085 (Mann) discloses a cup holder device where the two securing arms are secured to an armrest by a strap.

U.S. Pat. No. 5,302,000 (Ayotte) discloses a more permanent type of armrest attachment where a removable portion is adapted to be positioned in the main holder. This patent can be positioned in an inverted manner.

U.S. Pat. No. 5,238,212 (Dechellis) discloses a beverage container support, where as, the leaf-spring members are adapted to laterally engage the seat portion frictionally engaged thereto. Of course this requires more than one material to compile the unit. At the very least, it requires more than a single unitary structure.

U.S. Pat. No. 5,232,262 (Tseng) discloses an armchair mechanism to hold a beverage. Much of the disclosure appears to be related to the supporting plate having a pivot shaft allowing the supporting plate to be positioned in numerous positions.

U.S. Pat. No. 4,728,147 (Dutton) discloses a lawn chair cup holder where the strap attaches to the lateral portion of the armrest. This patent is created through the process of plastic injection molding, but is confined to the application of a lawn chair and includes the use a strap connector means, further including a hook portion and a loop portion, a first leg and a second leg.

U.S. Pat. No. 4,262,962 (Yust) discloses a stadium seat tray. The receiving key section slot is adapted to engage the armrest. The possibilities for adapting this patent to the arms of stadium surfaces are constrained by the configuration of the arms of a seat. Current stadium seating wherein the T-shaped cross-section does not extend all the way to the front of the seat precludes such sliding of a vessel holder across through the front of the arm of such stadium seating. Furthermore, this involves a plurality of vessel holders and this patent requires the beam member be of a length equal to a substantial portion of the length of the horizontal portion of the arm of the stadium seat, as well as width and depth each greater than said seat arm.

U.S. Pat. No. 3,690,724 (Douglas) discloses an armchair support where the partially cross-sectional view shows how the lug is firmly held within the perforations to adjust the lateral width of the unit.

Therefore, it can be appreciated that the various references above disclose a broad concept of a stadium-like seating device with an armrest cup holder retrofitted thereto.

SUMMARY OF THE DISCLOSURE

The disclosed embodiment is a vessel holder to be used in stadium seating where such holders have not already been adapted or are not sufficient for use. The disclosure is useful for holding drinks, hot dogs, peanuts and the like which are commonly found at stadiums and sporting events.

BRIEF DESCRIPTION OF THE DRAWINGS

FIG. 1 is an orthogonal view of an embodiment of the disclosure and of the axis system;

DESCRIPTION OF THE PREFERRED EMBODIMENTS

Figure 2:
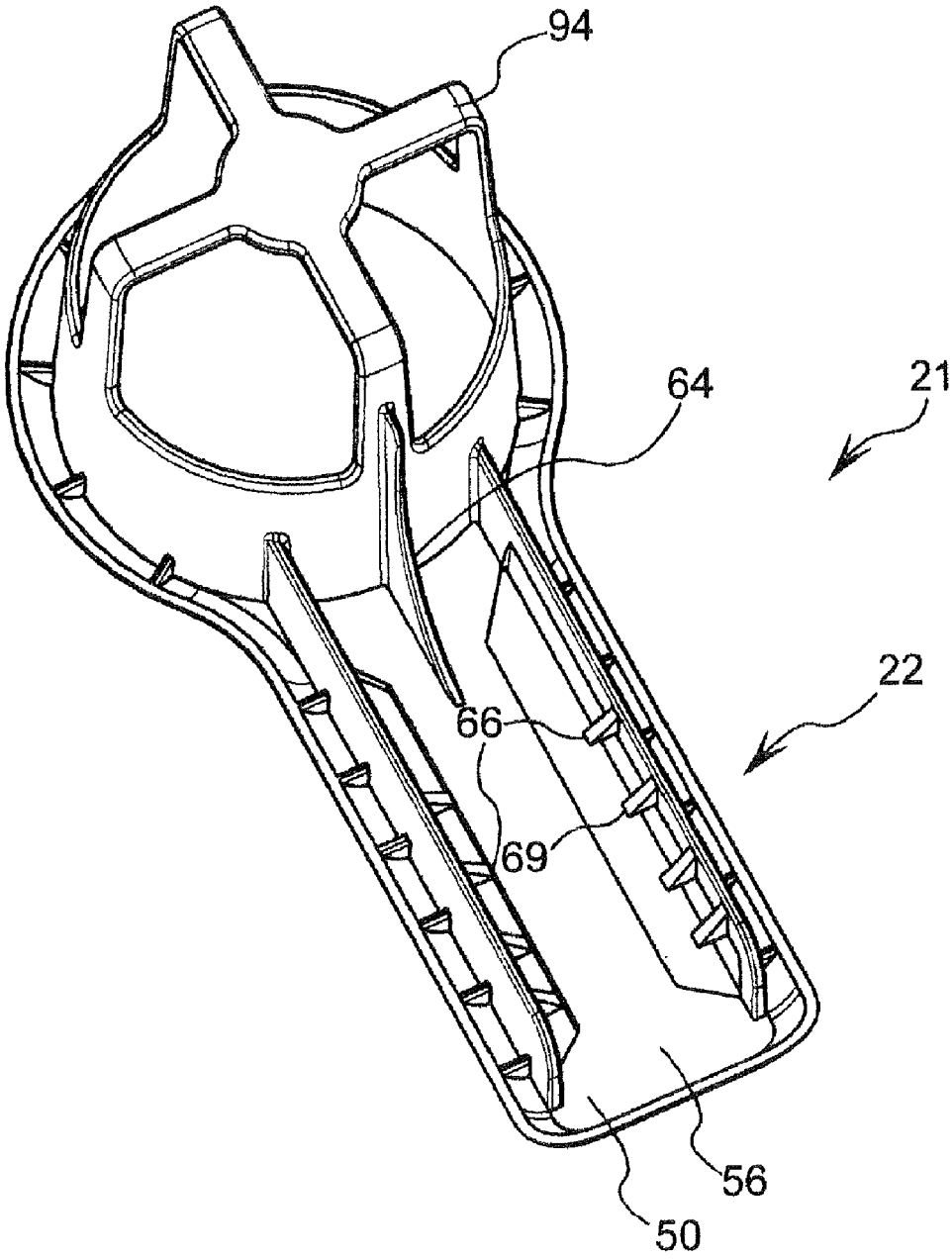
FIG. 2 is an orthogonal view of the underside of an embodiment of the disclosure.

Before going into a more detailed discussion an axis system 10 is utilized to help describe the drawings herein. In general the axis indicated at 12 indicates a longitudinal direction and the arrow points toward the basket. The axis indicated at 18 is a vertical axis and indicates a vertical direction, axes 16 and 14 indicate horizontal directions where 16 is directed herein referred to as the leftward direction and 14 indicates a rightward direction. Of course the axes described hereunder are for general reference purposes and generally locate directions for ease of description and general orientation of components described herein.

In general, the apparatus 21 in one form, is comprised of a seat mounting portion 22, an intermediate portion 28, and vessel holder portion 30. As further shown in FIG. 1, the seat mounting portion 22 has an upper surface 52 including surfaces defining voids 62 and an optionally chamfered edge 54. The term seat defined herein refers to stadium seating, chairs, lounges, stools, wheelchairs, or any other object to which the apparatus may be attached.

FIG. 2 shows the underside of the apparatus 21 in one form and shows the seat mounting portion 22 which includes injection molding gussets. These gussets can be used in forming the apparatus through the process of injection molding. This process may utilize seat mounting tabs 66 which will be described in detail later, and the second surface of the seat mounting portion 56 extending from the lower surface 50 of the apparatus 21. Further shown is a rigid basket support 64 which keeps the apparatus from bending when heavy objects are placed in the basket 94.

Figure 3:
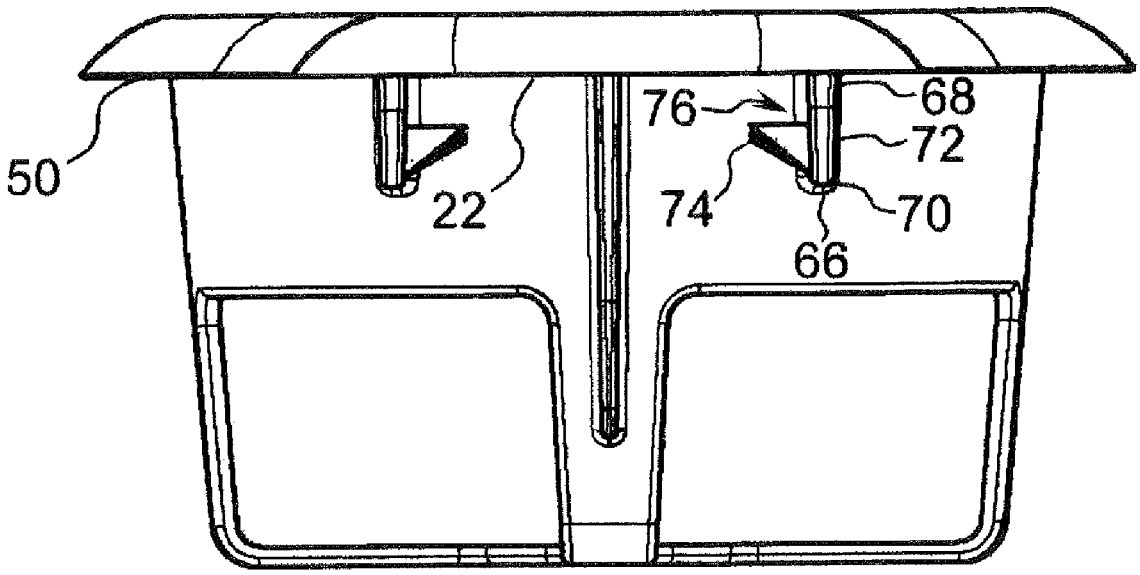
FIG. 3 is a close-up view of the extension tab 66.
Figure 4:
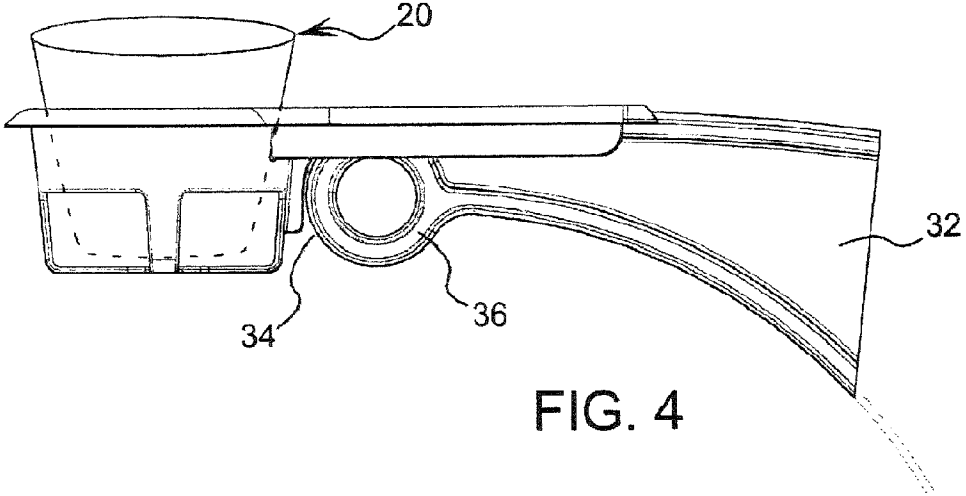
FIG. 4 is a side view of the apparatus 21 engaged in the upper surface of the seat arm 32.
Figure 5:
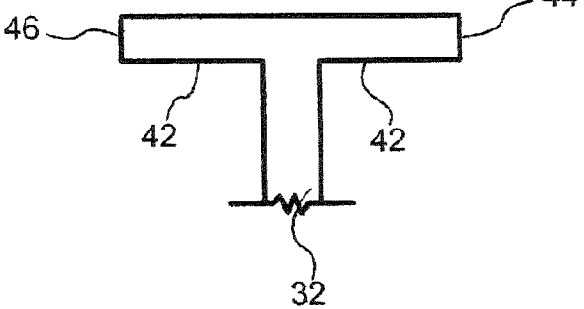
FIG. 5 is a cross-section of the underside of the upper surface of the arm 32.
Figure 8:
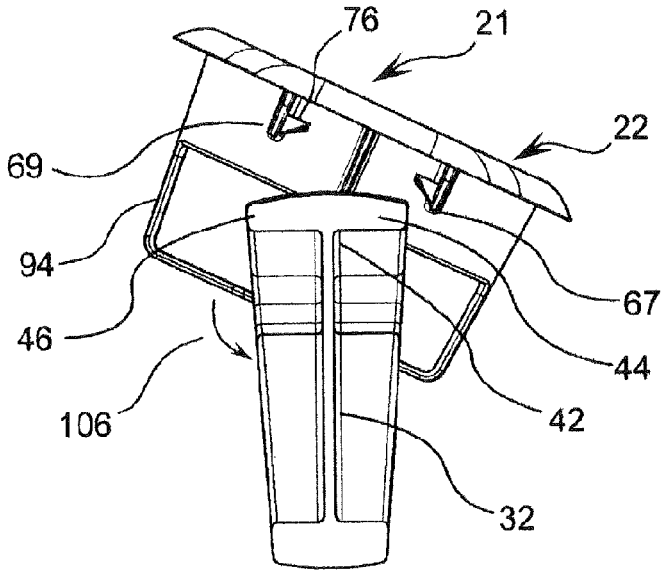
FIG. 8 is an end view of an embodiment of the disclosure and the means for attaching said embodiment to the arm of a seat.
Figure 10:
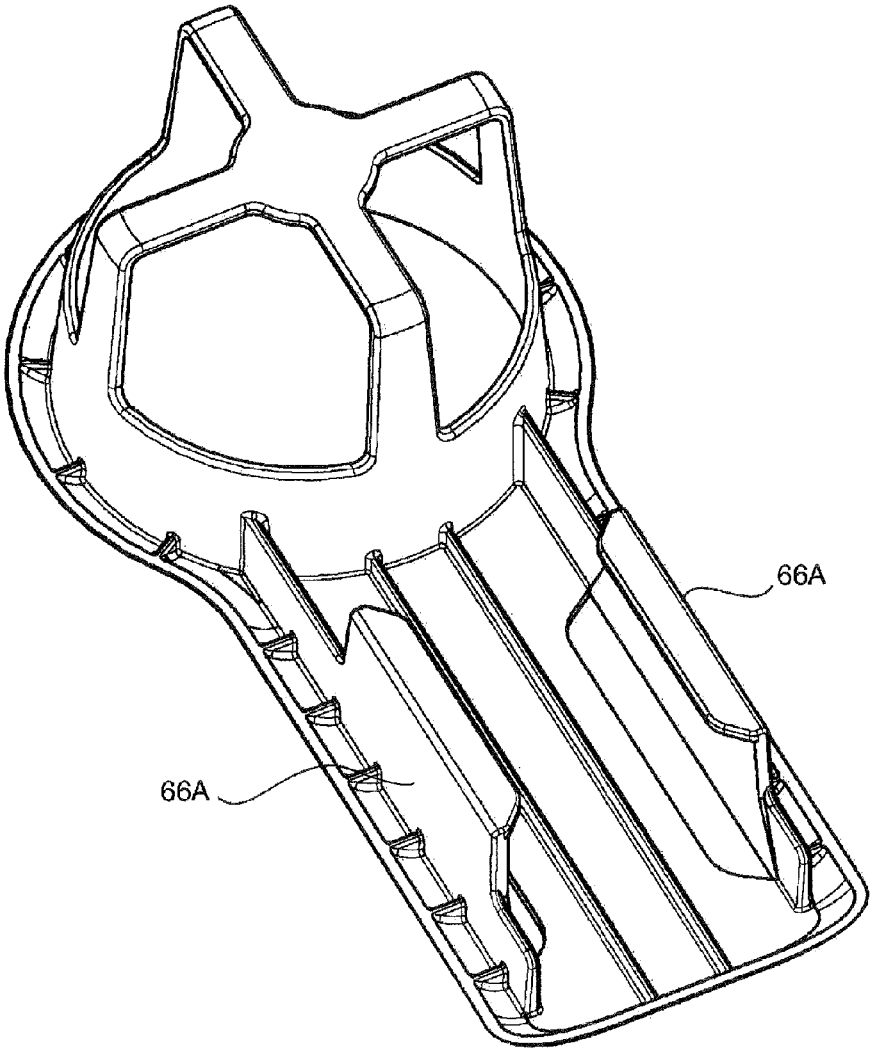
FIG. 10 is an orthogonal view of the underside of an embodiment of the disclosure.

Now referring to FIG. 3, the seat mounting tabs 66 are shown in detail. These tabs 66 consist of several portions; the first end 68 is coupled to the lower surface 50 of the seat mounting portion 22 and extends vertically downward therefrom. A vertical portion 72 of seat mounting tab 66 connects the first end 68 to the second end 70 of tab 66. Extending horizontally from the second end of tab 66 is a wedge-shaped portion 74 of tab 66 extending inwardly from the vertical portion 72. The wedged-shaped portion 74 of tab 66 includes an upper surface 76. The seat mounting tabs 66 can be provided in pairs configured to actively couple the apparatus 21 to the upper surface of the arm of a chair or stadium seat. As shown in FIG. 2, four pairs of these seat mounting tabs 66 are provided, generally directly below the surface defining injection access voids 62 for ease in production. FIG. 10 shows an alternate embodiment of these tabs 66A. The means for attachment to the arm of a seat in one form can be easily understood by referring to FIG. 8, and include the steps of generally aligning the seat mounting portion 22 to the upper surface of the arm of a seat such that the basket 94 of the vessel holder or apparatus 21 is longitudinally forward of the front surface of the seat as shown in FIG. 4, the surface being the front 34 of the seat arm 32. Looking at FIG. 8, the first set 67 of the seat mounting tab 66 is positioned underneath the extension 44 of the arm 32 of the seat as shown in FIG. 8. The seat mounting portion 22 is rotated 106 to engage the second set 69 of seat mounting tabs 66 underneath the second extension 46 of the arm 32 of the seat, and this expands the tabs 66 away from each other as they bend outwardly. Once beyond the extension members of the arm of the seat, they re-position themselves underneath the extension of the arm of the seat such that the upper surface 76 of the wedge 74 is in contact with the underside of the upper surface of the arm 42 of the seat.

Figure 6:
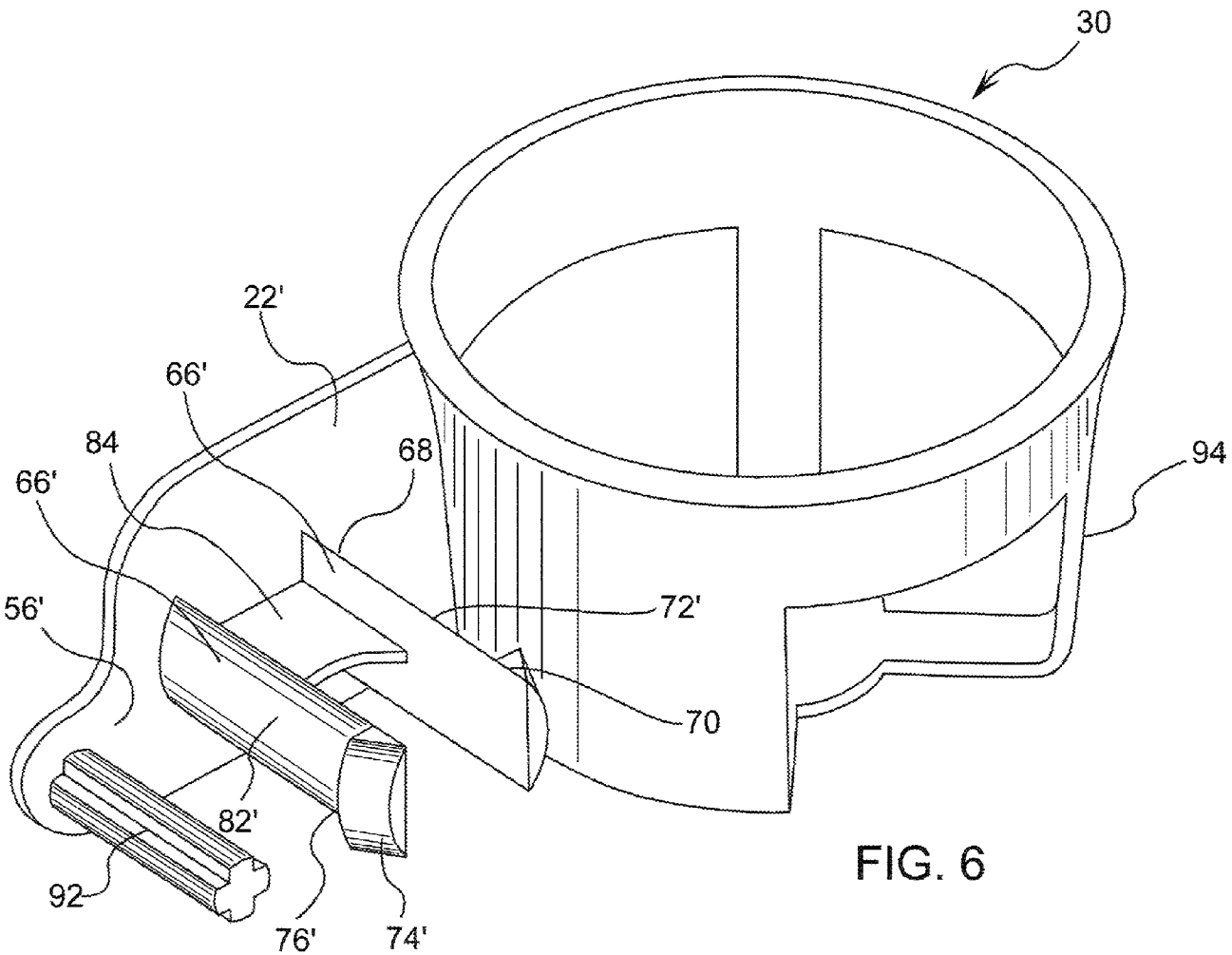
FIG. 6 is an orthogonal view of an embodiment of the disclosure.
Figure 7:
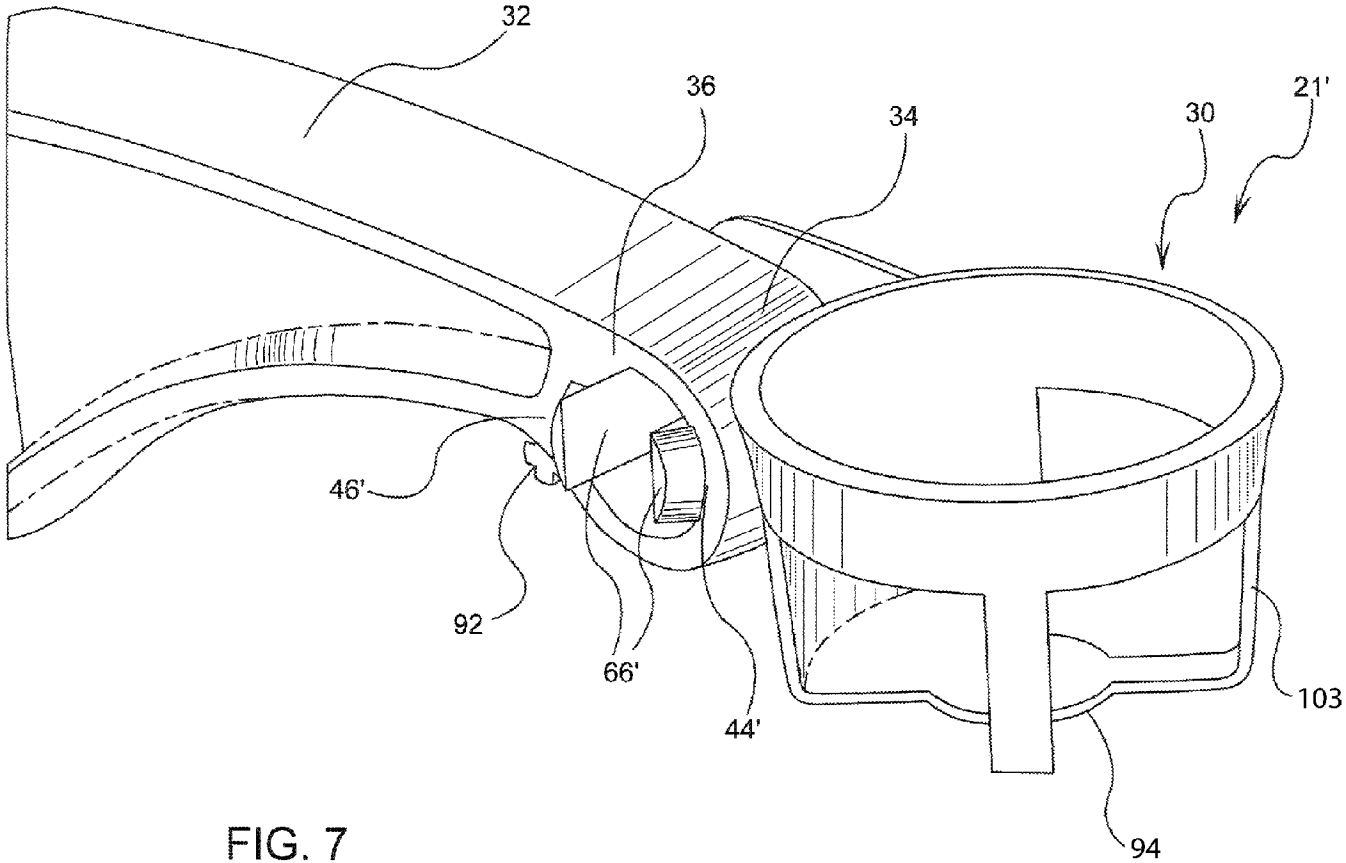
FIG. 7 is an orthogonal view of an embodiment of the disclosure operatively engaged in the arm of a seat rest.

In FIG. 6, a second embodiment is shown wherein the seat mounting portion 22' is configured to the side of the arm 32 of a seat (see FIG. 7), and this embodiment consists of seat mounting tabs 66' extending from an inward surface 56' of seat mounting portion 22' wherein a plurality of seat mounting tabs 66' extend from the inward surface 56' of the seat mounting portion 22'. The seat mounting tabs 66' have a first end 68 coupled to the inward surface 56' of seat mounting portion 22' and extending horizontally therefrom. A horizontal portion 72' connects the first end 68 with the second end 70 of seat mounting tabs 66'. The second end 70 of seat mounting tab 66' further includes a wedge-shaped portion 74' and also forms a vertical surface 76'. To strengthen the seat mounting tabs 66', a mounting tab support gusset 84 is included coupled to the plurality of the seat mounting tabs 66', and optionally coupled to the seat mounting portion 22', adding rigidity to the seat mounting tab 66'. Further included in this embodiment is an optional moment-resisting member 92 coupled to the inward surface 56' of the seat mounting portion 22'. The moment-resisting member 92 is shown in FIG. 7 resisting the moment of force around the pivot point formed by the seat mounting tabs 66' within the ring defining a void 36. The second embodiment is adaptively configured to the arm of a seat. The front portion 34 of the seat arm 32 includes a ring defining a void 36. This ring further includes a first extension 44' and a second extension 46' to operatively configure the second embodiment to the arm 32 of the seat. To use the apparatus, insert the seat mounting tab 66' into the ring defining a void, press the tabs into the ring defining a void, and the seat mounting tab 66' will compress inwardly to fit within the ring 36, and then expand once the wedge-shaped portion 74', specifically the vertical surface 76' of the wedge-shaped portion 74', is far enough into the ring 36 defining a void. The seat mounting tabs 66' will expand outwardly and the wedge-shaped portion 74' will resist removal of the apparatus 21' until desired. The movement resisting member 92 is shown in this environment as resting below of the arm of the seat and resisting the force about the created pivot point by any weight of the basket 94 or the vessel 20 and its contents. To increase the strength of the apparatus, one surface 82' of the tabs could be formed to conform to the inner surface of the ring 36. In this configuration the tabs could have a convex cross section. It is also conceived that the moment resisting member 92 may have an X-shaped cross section for stability.

Figure 11:
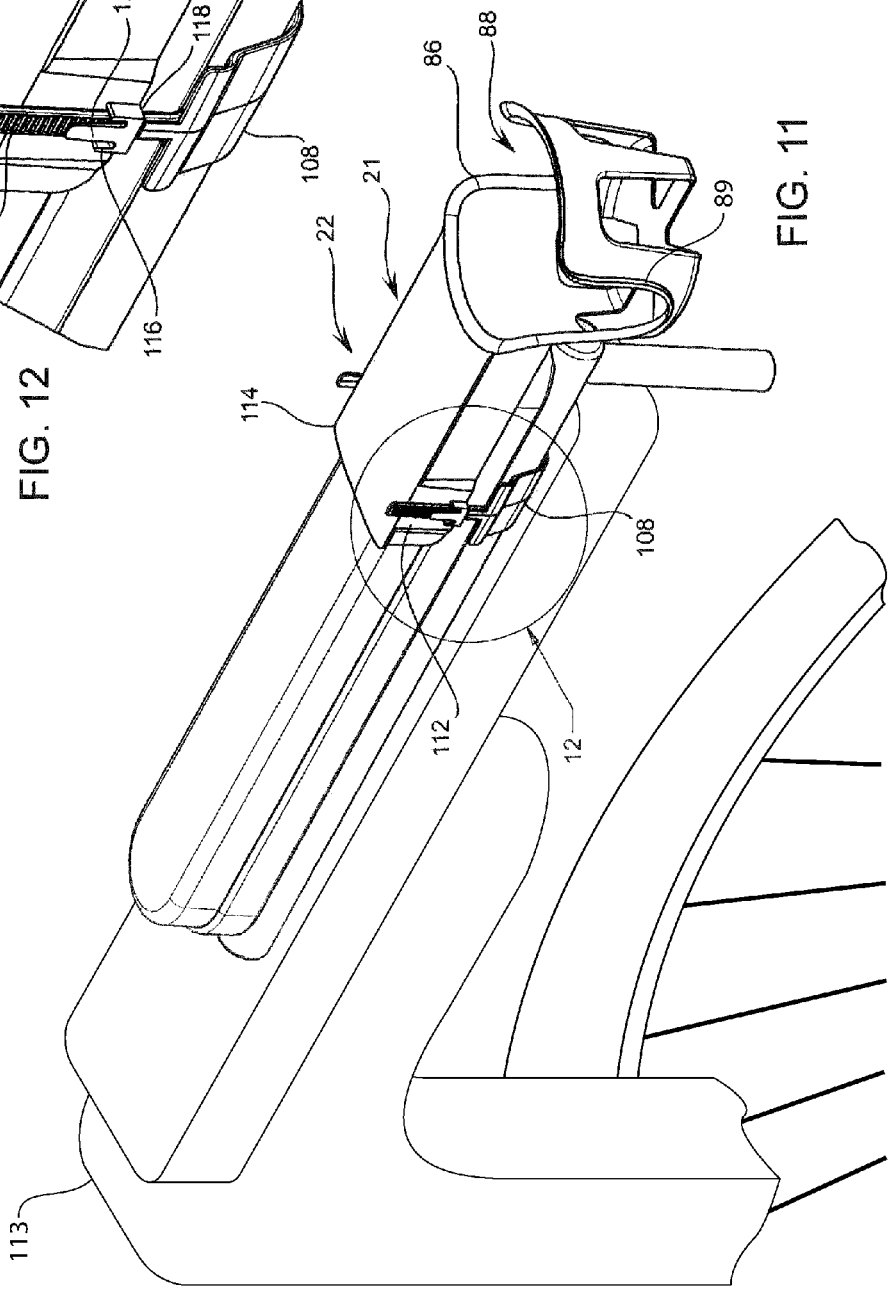
FIG. 11 is an orthogonal view of an embodiment of the disclosure showing a zip tie attachment.
Figure 13:
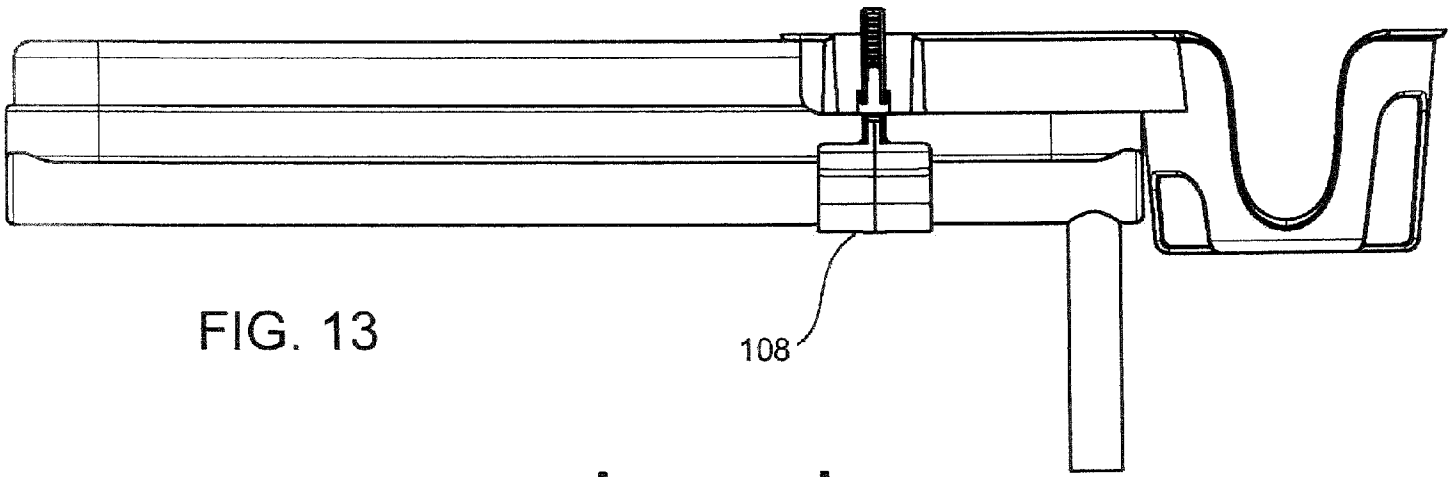
FIG. 13 is a side view of an embodiment of the disclosure showing a clip-on retainer embodiment.
Figure 14:
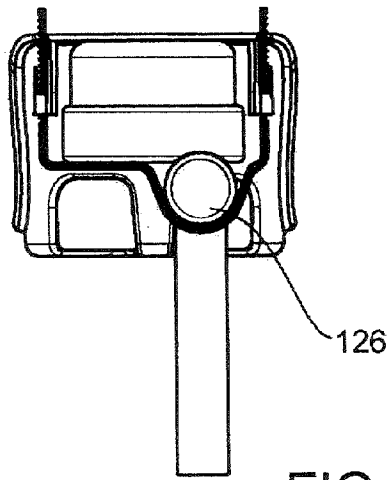
FIG. 14 is an end view of the embodiment of the disclosures shown in FIG. 13.

In one form shown in FIG. 11 a surface 86 is disclosed defining an opening 88. This opening 88 is useful as many vessels such as coffee cups have handles and said handles in many embodiments will prohibit the vessel from being completely retained by the basket 94 and other embodiments such as the embodiment of FIG. 1. The opening 88 is surrounded by an outwardly-directed projecting lip 89 formed in the basket support ring and in the basket, as shown in FIG. 11. The lip 89 strengthens the vessel holder 21.

Figure 12:
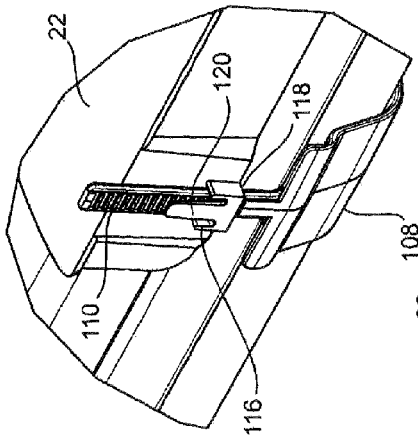
FIG. 12 is a detailed view of FIG. 11.

FIG. 11 also shows another embodiment of the attachment mechanism in one form. In this form, the apparatus 21 comprises a seat mounting portion 22. In this embodiment a strap 108 is disclosed which couples to a first side 112 of the seat mounting portion 22 optionally by way of a ratcheting portion as detailed in FIG. 12. The strap 108 also couples to the seat mounting portion 22 at the second side 114. As shown in FIG. 12, the ratcheting portion comprises a ribbed portion 110 which is a strap-like extrusion having a plurality of ribs on its surface. FIG. 11 also illustrates a wheeled apparatus 113 (e.g., a wheelchair) that the apparatus 21 may be coupled to as described briefly below in the particular embodiment of FIGS. 13 through 16.

The ribbed portion 110 of the strap 108 is configured to fit within an opening 118 of a receiver 116. The receiver 116 also has a release mechanism 120. The release mechanism 120 is configured such that when it is pulled away from the ribbed portion 110, the ribbed portion 110 is released and the apparatus 21 can be removed from the arm of the seat. This attachment structure can be repeated on the second side 114 of the seat mounting portion 22. Alternatively, the mechanism can be inverted such that the receiver 116 is disposed upon the strap 108 and the ribbed portion 110 is disposed upon or formed with the seat mounting portion 22.

Figures 15, 16:
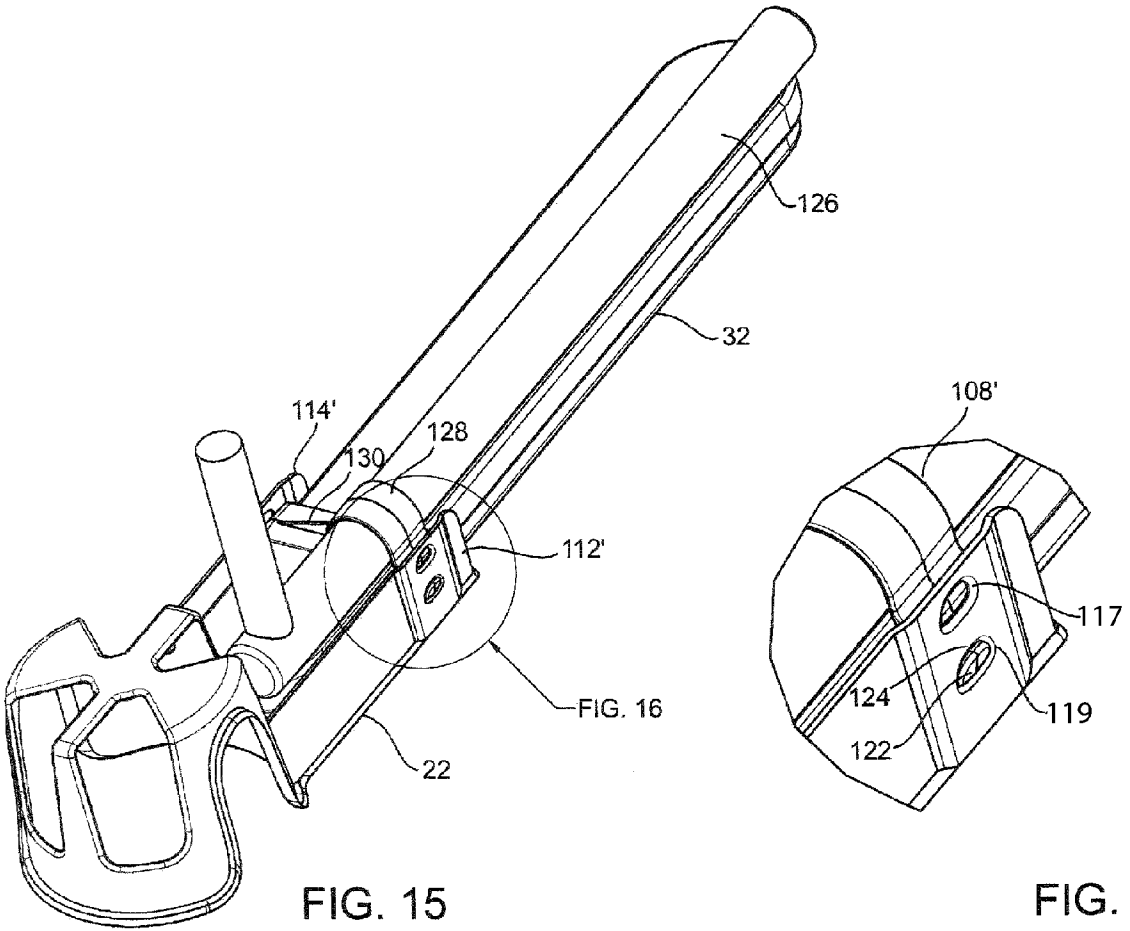
FIG. 15 is an orthogonal view of an embodiment of the disclosure with a clip-on retainer.
FIG. 16 is a detailed view of a portion of FIG. 15.

FIGS. 13 to 16 disclose another embodiment of the disclosure in one form. In one embodiment, the strap 108' has a plurality of snap in tabs 117 disposed thereon. The first side 112' and second side 114' of the seat mounting portion 22 have a plurality of openings 119 disposed thereon. These openings 119 are configured to retain the snap in tabs 117 when the seat mounting portion 22 is coupled to the arm 32 of the seat. The snap in tabs 117 may be formed of a wedge-shaped protrusion which has a ramp surface 122 and a retaining surface 124. These operate similarly to the seat mounting tab 66' of FIG. 6. This embodiment is especially useful to wield the arms 32 of wield apparatus such as wheelchairs which oftentimes have a tubular structure on 126. The tubular structure 126 is often the structural portion of the chair and the arm 32 is disposed thereon. To enable attachment to such arms, the strap 108' may be provided with a bar loop 128 as shown in FIG. 15. A support gusset 130 may be formed upon the surface of the strap 108' to further structurally enhance the apparatus. To utilize this embodiment of the disclosure, the seat mounting portion 22 is placed upon the arm 32 of the chair and the strap 108' is positioned below the tube structure 126 and pressed upwardly into place such that the snap in tabs 117 fit within the openings 119 and snap fit into place. Optionally a plurality of openings 119 may be provided to enable the apparatus 21 to be attached to chairs having arms 32 of varying thicknesses.

Figure 17:
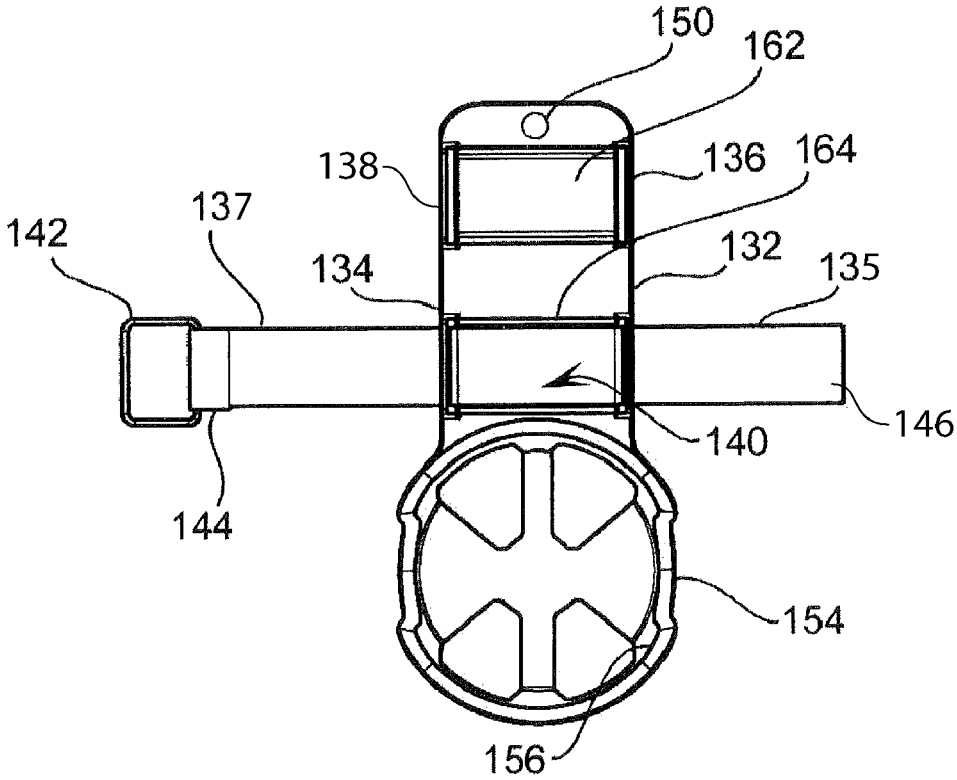
FIG. 17 is a plan view of an embodiment of the disclosure showing a strap-on embodiment.
Figure 18:
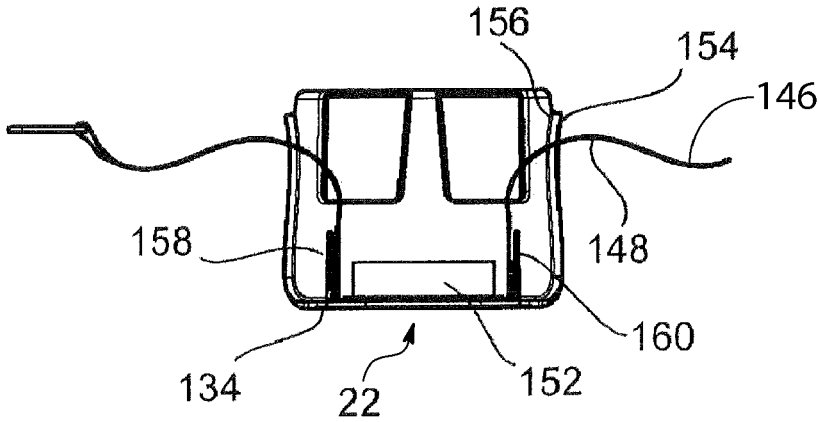
FIG. 18 is an end view of the embodiment of FIG. 17

One additional embodiment of the disclosure is shown in FIGS. 17 and 18 wherein the seat mounting portion 22 comprises a plurality of openings 132 and 134. Additional openings 136 and 138 may also be provided enabling a wide variety of attachments, as will be understood by repeating the attachment method herein disclosed. In this embodiment a first strap 135 is passed through the opening 132 and may be partially set within a recess 164. A second strap 137 may also be passed through the opening 134 and may be partially retained by a recess 164. These straps 135, 137 may be coupled to the seat mounting portion 22, or may alternatively be of a unitary structure wherein they pass on the upper surface of the arm of the seat, as shown in FIG. 17 at point 140. The second strap 137 may comprise an eye portion 142. The eye portion 142 is configured to accept a first strap 135. The eye 142 may be stitched 144 to the second strap 137. In one form to utilize this embodiment, the first strap 135 comprises a first surface 146 and a second surface 148. The first strap 135 is passed through the eye 142 and reversed back upon itself wherein the first surface 146 comes in contact with the second surface 148. An adhering apparatus may be disposed upon the first and second surface of the first strap 135. For example, a hook and loop attachment system therein may be used wherein a hook surface is disposed upon the first surface 146, and a loop surface is disposed upon the second surface 148, wherein the two surfaces will adhere to one another when they come in contact with each other, and can be readily detached for removal of the apparatus 21. Alternatively, the first strap 135 may have a first part of the hook and loop structure, and the second strap 137 may have the second part of the hook and loop structure, wherein the first strap 135 will adhere to the second strap 137 and similarly couple the device to the arm of the chair. A second set of openings 136 and 138 are also provided in one form so that if a structural member of the chair should prohibit the attachment through the first openings 132 and 134, the second set of openings 136 and 138 can be alternatively used. It is also conceived for increased structural support that an additional strap would be provided and coupled via the second set of openings 136 and 138.

A plurality of extending members 158 and 160 may be provided which enhance the structural rigidity of the apparatus, and also restrict side to side and rotational movement of the apparatus in relation to the arm of the chair.

Further, there may be included a foam-like member 152 having a lower diopter rating (between 20 and 50 durometer rating which provides a cushioning elastic effect having a lower Young's modulus of elasticity to have this portion in compression when applied so as to tighten the fit between the unit and the armchair member. For, the coefficient of friction is at least greater than 0.4 to help keep the unit on the armchair. A surface defining a hole 150 may be provided. This hole may be configured to hang the unit for display or when not in use. Further, when hanging in a vertical orientation, the nesting effect of the units can be employed where the outer surface 154 of the cup-holding region fits within the inner surface 156 of an immediately adjacent rearward member cup-holding member when, for example, stacked on a peg for sales or storage purposes.

Further, the unit can have a display portion in the upper surfaces to possibly display team logos or the like. This can be attached after the plastic injection molding process by way of an adhesive-type sticker or the like. Or it could be a part of the molding process wherein, for example, an insert is a part of the mold to provide a custom logo embedded on the upper surface or any available surface.

In one form shown in FIG. 1, the disclosure involves a plurality of basket support members 103 extending vertically from the basket support ring 102 and connecting at a basket center 104. In FIG. 1 there is a plurality of four support members 103, whereas in FIG. 7 three support members 103 form the basket 94.

Figure 9:
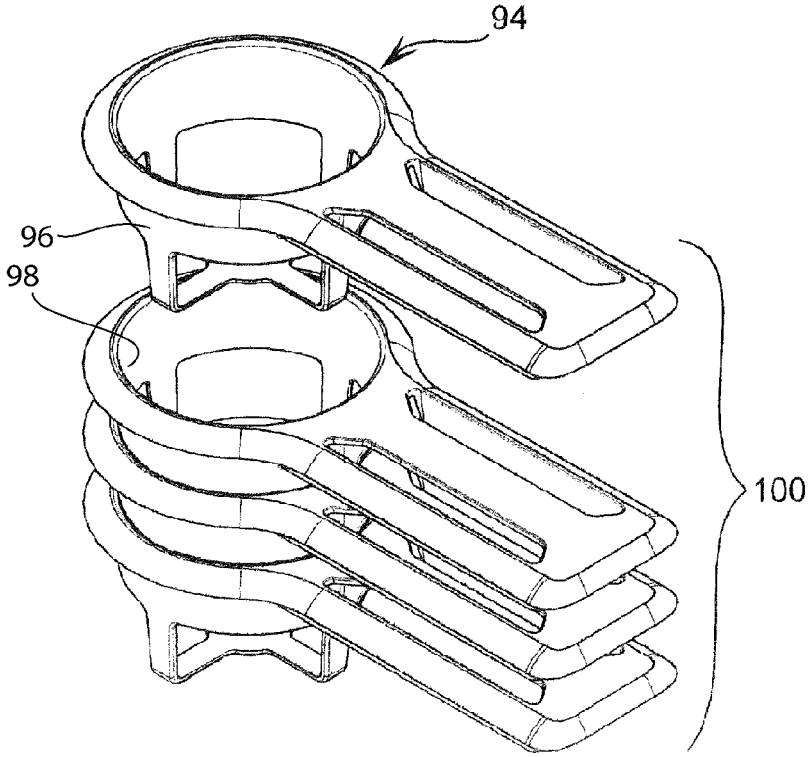
FIG. 9 is a view of a plurality of embodiments of the disclosure stacking therewith.

As with any mass produced article, space is always a factor within the cost of sales. As shown in FIG. 9, the apparatus 21 can be configured in such a way that the basket 94 is a frusto-conical surface wherein the exterior 96 of a basket 94 fits largely within the interior 98 of another basket 94 and the apparatus 21 can be effectively stacked 100 as shown in FIG. 9.

Considering the current state of our landfills and the problems that many plastics cause to long term disposal issues, an apparatus produced from a biodegradable medium may be advantageous.

While the present invention is illustrated by description of several embodiments and while the illustrative embodiments are described in detail, it is not the intention of the applicant to restrict or in any way limit the scope of the appended claims to such detail. Additional advantages and modifications within the scope of the appended claims will be readily apparent to those sufficient in the art. The invention in its broader aspects is therefore not limited to the specific details, representative apparatus, and methods, and illustrative examples shown and described. Accordingly, departures may be made from such details without departing from the spirit or scope of the applicant's general concept.

We claim:

1. A vessel holder removably coupled to a seat having arms, wherein a surface of an arm of the seat includes a front end, a top surface, and a bottom surface, and the vessel holder comprises:

a) a rigid basket including basket support members and a basket center defining a bottom of the basket, b) a basket support ring supporting the basket, the basket support members extending between the basket support ring and the basket center, c) a seat mounting portion including a first side and a second side, the seat mounting portion coupled to the basket support ring and configured to extend beyond the front end of the arm of the seat, the seat mounting portion also including a surface defining a first opening disposed in the first side, and a surface defining a second opening disposed in the second side, and d) a retaining structure coupled to the seat mounting portion coupled to the first side of the seat mounting portion and configured to extend under the bottom surface of the arm of the seat, around the arm of the seat, and couple to the second side of the seat mounting portion, the retaining structure including a first strap coupled to the surface defining the first opening such that the first strap extends through and is retained by the first opening, and a second strap coupled to the surface defining the second opening such that the second strap extends through and is retained by the second opening, wherein the first strap is adaptively configured to couple to the second strap in such a way as to secure the seat mounting portion to the arm of the seat, wherein the rigid basket, the basket support ring, and the seat mounting portion are integrally formed as a unitary structure, wherein each of the first and second straps includes a ribbed portion having a plurality of projections, and wherein the first and second openings are sized to be smaller than the respective first and second straps at the projections such that the ribbed portions of the first and second straps are prevented from being withdrawn from the first and second openings.

2. The vessel holder of claim 1, wherein the seat having arms is a portion of a wheeled apparatus.

3. The vessel holder of claim 1, wherein the first strap and the second strap comprise a unitary structure.

4. The vessel holder of claim 1, further comprising:

a rigid basket support integrally formed with and extending between the basket and the seat mounting portion, the rigid basket support configured to stabilize the basket.

5. The vessel holder of claim 1, wherein the basket includes an inner surface configured to face toward a vessel retained by the basket and an outer surface configured to face away from the vessel, the outer surface and inner surface being sized such that when a first vessel holder is stacked on top of a second vessel holder, the outer surface of the basket of the first vessel holder nests closely against the inner surface of the basket of the second vessel holder.

6. The vessel holder of claim 1, wherein the basket support ring includes at least one opening configured to receive handles or other radial protrusions extending from a vessel retained by the basket.

7. The vessel holder of claim 6, wherein the opening is surrounded by an outwardly projecting lip formed on the basket and on the basket support ring, the outwardly projecting lip strengthening the vessel holder at the opening.

8. The vessel holder of claim 1, wherein each of the first and second openings is coupled to a release mechanism, the release mechanism operable to be pulled away from the respective opening to expand the size of the opening and enable the ribbed portion of the first or second strap to be withdrawn from the opening.

* * * * *